US010172411B2

(12) United States Patent
Svensson

(10) Patent No.: US 10,172,411 B2
(45) **Date of Patent: *Jan. 8, 2019**

(54) BASE FOR A SKI BOOT AND SKI BOOT INCORPORATING SUCH A BASE

(71) Applicant: K2 Sports, LLC, Seattle, WA (US)

(72) Inventor: John Erik Svensson, Vashon, WA (US)

(73) Assignee: K2 SPORTS, LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,055

(22) Filed: Jul. 14, 2017

(65) Prior Publication Data

US 2017/0311676 A1 Nov. 2, 2017

Related U.S. Application Data

(63) Continuation of application No. 15/051,649, filed on Feb. 23, 2016, now abandoned, which is a (Continued)

(51) Int. Cl.
*A43B 5/04* (2006.01)
*A43B 21/36* (2006.01)
(Continued)

(52) U.S. Cl.
CPC ..... *A43B 5/0427* (2013.01); *A43B 5/0411* (2013.01); *A43B 5/0413* (2013.01);
(Continued)

(58) Field of Classification Search
CPC ..... A43B 21/54; A43B 21/36; A43B 13/38; A43B 5/04; A43B 5/0417; A43B 5/0421
(Continued)

(56) References Cited

U.S. PATENT DOCUMENTS 3,273,263 A 9/1966 Klima
4,231,169 A 11/1980 Toyama et al.
(Continued)

FOREIGN PATENT DOCUMENTS

DE 33181818 A1 11/1984
DE 202009004813 U1 5/2009
(Continued)

OTHER PUBLICATIONS

Cross-Country Skiing, Wikipedia.org, Jun. 17, 2007, <http://en.wikipedia.org/w/index.php?title=Cross-country_skiing&printable=yes> [retrieved Jun. 20, 2007]. 11 pages.
(Continued)

*Primary Examiner* — Marie D Bays
(74) *Attorney, Agent, or Firm* — Christensen O'Connor Johnson Kindness, PLLC; Ryan E. Dodge, Jr.

(57) ABSTRACT

A base is provided for a ski boot comprising a sole and an outsole element that is positioned in a predetermined position relative to a longitudinal axis (L). The outsole element is positioned on the sole by using two projections that are carried by one or other of the sole and the outsole element and that locate in holes or cavities defined by the other. Preferably, the projections are carried by the outsole element and locate in holes or cavities defined by the sole. The projections may be integrally formed with the outsole element or the sole. Alternatively, they may be formed by injected pins, rivets, fasteners, t-nuts, or screws.

12 Claims, 5 Drawing Sheets

Related U.S. Application Data continuation of application No. 13/662,248, filed on Oct. 26, 2012, now Pat. No. 9,265,300.

(51) Int. Cl.
*A43B 13/02* (2006.01)
*A43B 13/36* (2006.01)
*A43B 13/12* (2006.01)

(52) U.S. Cl.
CPC ..... *A43B 5/0417* (2013.01); *A43B 5/0421* (2013.01); *A43B 5/0486* (2013.01); *A43B 13/023* (2013.01); *A43B 13/026* (2013.01); *A43B 13/122* (2013.01); *A43B 13/36* (2013.01); *A43B 21/36* (2013.01)

(58) Field of Classification Search
USPC ..... 36/117.1, 117.3, 117.5, 119.1, 12, 19.1, 36/23, 24
See application file for complete search history.

(56) References Cited

U.S. PATENT DOCUMENTS

| | | | |
|---|---|---|---|
| 4,351,120 | A | 9/1982 | Dalebout |
| 4,499,674 | A | 2/1985 | Olivieri |
| 4,562,653 | A | 1/1986 | Salomon |
| 4,651,445 | A | 3/1987 | Hannibal |
| 4,839,972 | A | 6/1989 | Pack et al. |
| 4,937,955 | A | 7/1990 | Bonaventure |
| 4,998,358 | A | 3/1991 | Girardelli |
| 5,066,036 | A | 11/1991 | Broughton |
| 5,214,865 | A | 6/1993 | Sartor |
| 5,243,773 | A | 9/1993 | Robic |
| 5,293,702 | A | 3/1994 | Miyoshi et al. |
| 5,311,677 | A | 5/1994 | Mann et al. |
| 5,400,527 | A | 3/1995 | Marega et al. |
| 5,452,526 | A | 9/1995 | Collins |
| 5,832,634 | A | 11/1998 | Wong |
| 5,918,338 | A | 7/1999 | Wong et al. |
| 5,992,861 | A | 11/1999 | Piotrowski |
| 6,065,228 | A | 5/2000 | Begey et al. |
| 6,082,744 | A | 7/2000 | Allinger et al. |
| 6,168,184 | B1 | 1/2001 | Simonelli et al. |
| 6,202,326 | B1 | 3/2001 | Hauglin et al. |
| 6,216,366 | B1 | 4/2001 | Donnadieu |
| 6,233,848 | B1 | 5/2001 | Bonaventure |
| 6,289,610 | B1 | 9/2001 | Girard et al. |
| 6,442,870 | B1 | 9/2002 | Tsai |
| 6,588,125 | B2 | 7/2003 | Proctor, Sr. |
| 6,685,213 | B2 | 2/2004 | Hauglin et al. |
| 6,782,642 | B2 | 8/2004 | Knoche et al. |
| 6,938,362 | B2 | 9/2005 | Saillet et al. |
| 6,964,118 | B2 | 11/2005 | Parisotto et al. |
| 6,971,652 | B2 | 12/2005 | Bobbert et al. |
| 7,461,469 | B2 | 12/2008 | McClaskie |
| 7,591,085 | B2 | 9/2009 | Haugltn |
| 7,832,117 | B2 | 11/2010 | Auger et al. |
| 8,960,711 | B2 | 2/2015 | Svensson |
| 9,265,300 | B2 * | 2/2016 | Svensson ..... A43B 5/0486 |
| 2002/0000052 | A1 | 1/2002 | Orso |
| 2002/0088146 | A1 | 7/2002 | Joseph et al. |
| 2002/0092207 | A1 | 7/2002 | Girard et al. |
| 2005/0115117 | A1 | 6/2005 | Morlin |
| 2005/0280221 | A1 | 12/2005 | Haugen et al. |
| 2005/0280222 | A1 | 12/2005 | Sauter et al. |
| 2008/0127523 | A1 | 6/2008 | Hauglin |
| 2009/0113763 | A1 | 5/2009 | Narajowski et al. |
| 2010/0115798 | A1 | 5/2010 | Sartor et al. |
| 2011/0107622 | A1 | 5/2011 | Schwirian |
| 2012/0151801 | A1 | 6/2012 | Miette |
| 2014/0115930 | A1 | 5/2014 | Svensson |

FOREIGN PATENT DOCUMENTS

| | | | |
|---|---|---|---|
| EP | 0712587 | A1 | 5/1996 |
| EP | 0815756 | A1 | 1/1998 |
| EP | 2250916 | A1 | 11/2010 |
| EP | 2465371 | A1 | 6/2012 |
| FR | 2336152 | A1 | 7/1977 |
| FR | 2358117 | A1 | 10/1978 |
| FR | 2887178 | A1 | 12/2006 |
| FR | 2971675 | A1 | 8/2012 |
| GB | 2256784 | A | 12/1992 |
| WO | 91/09547 | | 7/1991 |
| WO | 99/21625 | A1 | 5/1999 |
| WO | 02/052969 | A1 | 7/2002 |
| WO | 2007/150068 | A2 | 12/2007 |

OTHER PUBLICATIONS

European Search Report dated Feb. 27, 2015, issued in corresponding European Application No. EP 14 184172.6, filed Sep. 26, 2013, 2 pages.

Hale, P., "NIS: A Revolution in Nordic Bindings," Skinny Skis C-Corp, Jan. 17, 2006, <http://www.skinnyskis.comarticle.aspx?id=10003> [retrieved Jun. 20, 2007]. 3 pages.

International Search Report and Written Opinion dated Feb. 21, 2013, issued in corresponding International Application No. PCT/US2012/068607, filed Jul. 12, 2012, 8 pages.

Muha, M., "Nordic Integrated System," NordicSkiRacer.com, Jan. 26, 2005, <http://www.nordicskiracer.comEquipment/2005/NIS/NIS_asp> [retrieved Jun. 20, 2007], 5 pages.

NIS—Nordic Integrated System, Madshus, n.d., <http://www.madshus.com/mhtemplates/Page_aspx?id=332> retrieved Jun. 20, 2007], 2 pages.

Partial European Search Report dated Apr. 17, 2014, issued in corresponding European Application No. EP 13 18 6219, 7 pages.

* cited by examiner

BASE FOR A SKI BOOT AND SKI BOOT INCORPORATING SUCH A BASE

CROSS-REFERENCE TO RELATED APPLICATION

This application is a continuation of U.S. application Ser. No. 15/051,649, filed on Feb. 23, 2016; said application Ser. No. 15/051,649 is a continuation application of U.S. application Ser. No. 13/662,248, filed Oct. 26, 2012; the entire disclosures of said applications are hereby incorporated by reference.

BACKGROUND

The present invention relates to a base for a ski boot, preferably but not exclusively a Nordic ski boot, and to a ski boot incorporating such base.

Although the word "boot" is used throughout this specification and in the claims, it should be interpreted broadly to include shoes and any form of footwear suitable for wear when taking part in skiing.

Ski boots are a specialized form of footwear that is used in skiing to provide a way of attaching the skier's feet to his/her skis via ski bindings. The ski boot should position the skier's body over the ski properly. The base of such a boot usually comprises rigid cleats or outsole elements that are used to fasten the boot to a ski binding. These outsole elements also comprise a walking surface for the boot. It is therefore important for the base of the boot, which incorporates the outsole elements, to provide strength and torsional stiffness yet still be sufficiently flexible for the intended form of skiing and for ease of walking. It is also important for the base to incorporate the outsole elements in a manner which retains them securely in a correctly orientated manner in order that the base will connect correct to a ski binding so that in use the boot is orientated correctly with respect to the ski. Conventionally, outsole elements are bonded to a previously formed sole and it is often difficult for the boot maker to judge exactly where to position the outsole elements relative to the sole to ensure that they are bonded in the correct position. The boot maker has to decide where the longitudinal axis of the sole lies and then locate and bond the outsole elements to the sole relative to this axis. Even a slight misalignment of the outsole elements can make connection to a ski binding difficult and significantly reduce the performance of the boot in use so that location of the outsole elements with precision is important.

It is an aim of the present invention to overcome or substantially mitigate the aforementioned problem and to provide a base and a ski boot incorporating such a base to which the outsole elements have been attached with precision.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to a first aspect of the present invention there is provided a base for a ski boot comprising a sole and an outsole element that is positioned in a predetermined position relative to a longitudinal axis of the sole by two projections that are carried by one or other of the sole and the outsole element and that locate in holes or cavities defined by the other.

Preferably, at least one of the projections is carried by the outsole element. Advantageously, both projections are carried by the outsole element and locate in holes or cavities defined by the sole.

Preferably also, toe and heel outsole elements are provided that are each provided with at least two projections that locate into holes or cavities defined by toe and heel portions of the sole respectively.

Preferably also, the projections are integrally formed with the outsole element. Alternatively, the projections are formed by injected pins, rivets, fasteners, t-nuts, or screws that are secured to the outsole element and that locate into the cavities or holes defined by the sole. In a further variation, the projections are formed by injected pins, rivets, fasteners, t-nuts, or screws that are secured to the sole and that locate into cavities or holes defined by the outsole element.

Preferably also, the holes or cavities are moulded into the sole during its production.

Preferably also, the sole comprises a fibre-reinforced composite structure.

Preferably also, the fibre-reinforced composite structure comprises a laminate wherein a plurality of layers of woven fabric comprising warp carbon fibre yarns and weft carbon fibre yarns are encapsulated within a polymer matrix, which is preferably an epoxy-based resin.

Preferably also, the outsole elements comprise rigid elastomeric elements that are bonded to the sole via an adhesive.

Preferably also, an additional outsole element comprising a rigid bar is fastened to the sole adjacent or at a forward end of said toe outsole element via at least two fasteners.

Preferably also, the outsole element comprising the rigid bar is fastened to the sole at the forward end of said toe outsole element, the fasteners penetrating through the toe outsole element into the sole.

Preferably also, the fasteners penetrate through the sole.

Preferably also, the base comprises a heel portion integrally formed with an upstanding portion that is adapted to wrap up around the back and sides of the heel of the ski boot.

Preferably also, the upstanding portion is adapted for connection to an ankle cuff.

Preferably also, the heel portion of the sole defines an interior cavity. Advantageously, a resilient pad is secured within the cavity to provide heel lift and to cushion the foot during use.

According to a second aspect of the present invention there is provided a base for a ski boot comprising a sole made from a fibre-reinforced composite structure and an outsole element that is detachably connected to a structural portion of the sole by at least one fastener that locates in a hole or cavity defined by the sole in a predetermined position relative to a longitudinal axis of the sole.

Preferably, the fastener is a releasable fastener allowing the outsole element to be attached to or detached from the sole as desired.

According to a third aspect of the present invention there is provided a ski boot incorporating a base in accordance with the first aspect of the present invention. Preferably, the ski boot has a flexible fabric upper.

Preferably also, the base comprises a heel portion integrally formed with the sole, which heel portion is wrapped up around the back and sides of the heel of the ski boot.

Preferably also, the heel portion is connected to an ankle cuff in a hinged manner.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
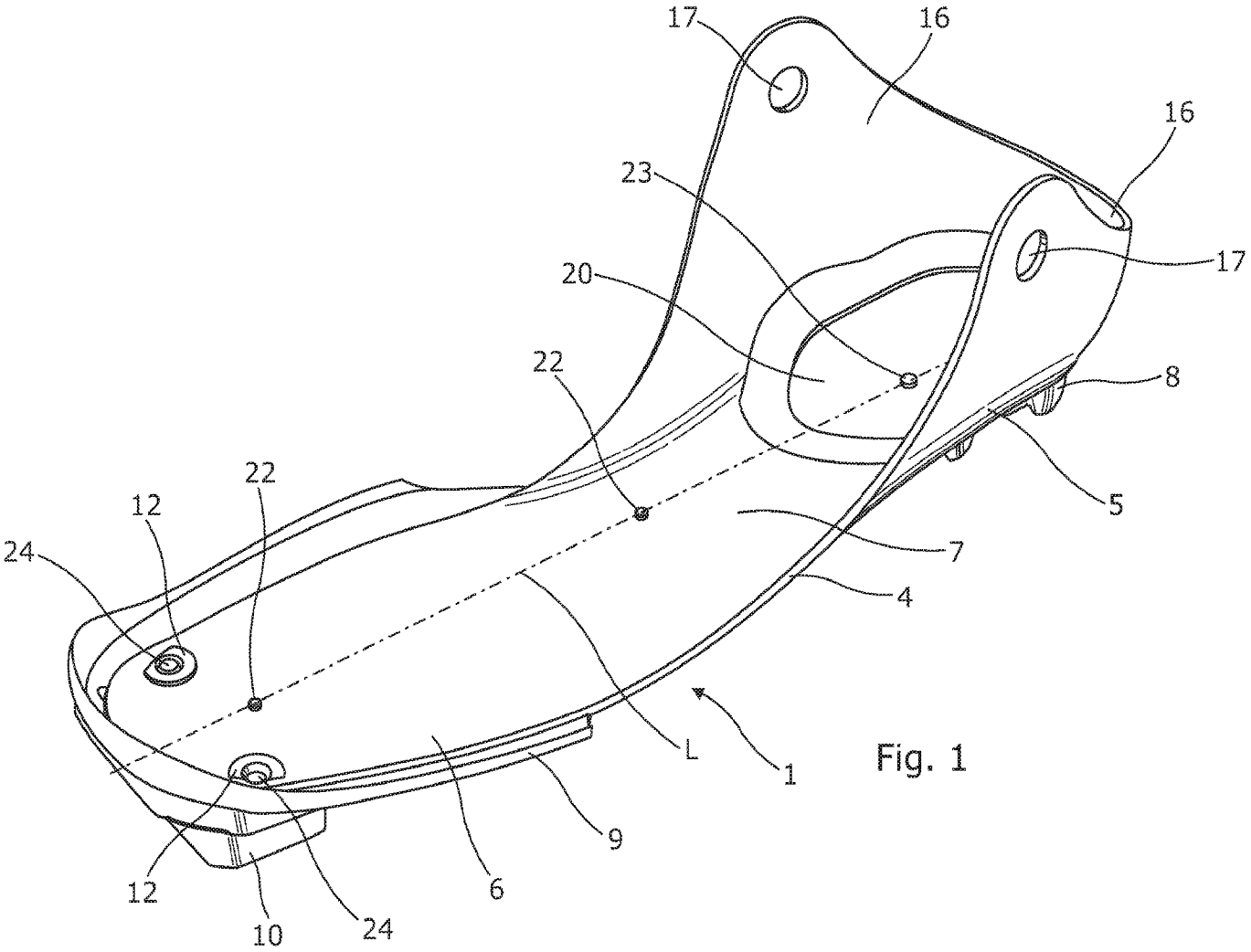
FIG. 1 is perspective view from above and one side of a base for a ski boot in accordance with the first aspect of the present invention.
Figure 2:
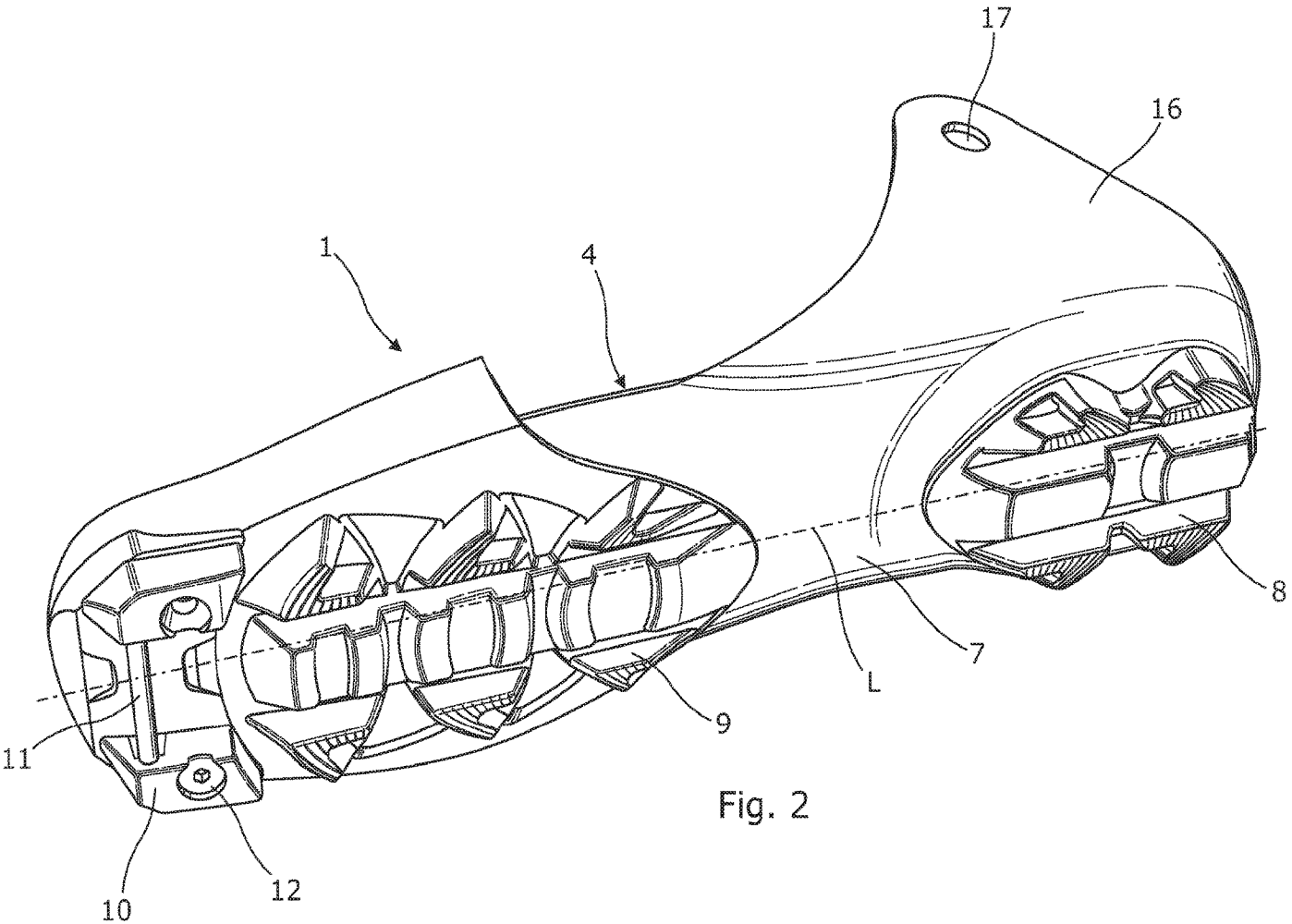
FIG. 2 is perspective view from below and said one side of the base shown in FIG. 1.
Figure 3:
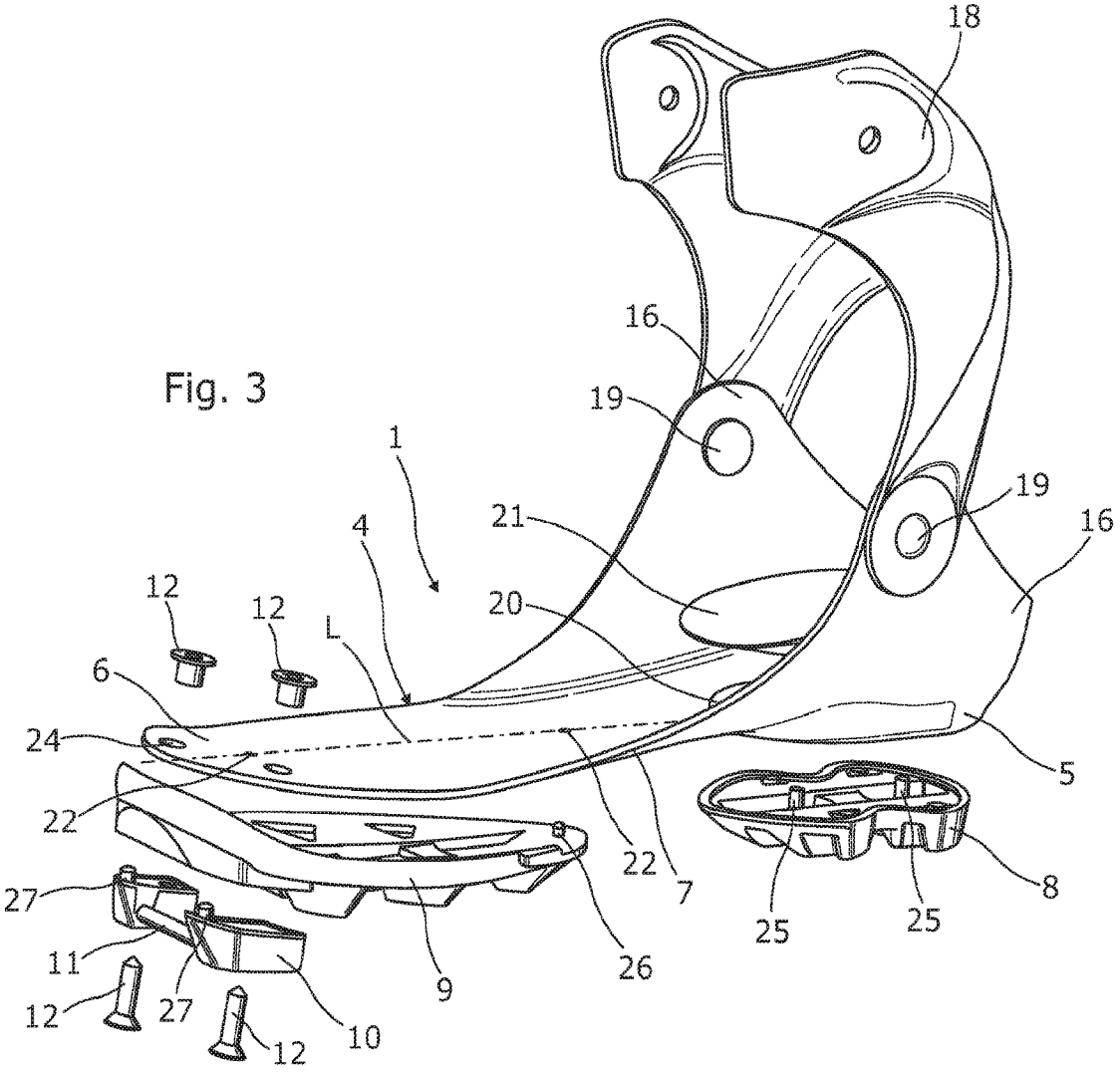
FIG. 3 is an exploded view of the base shown in FIGS. 1 and 2 along with a cuff for attachment to the base.
Figure 5:
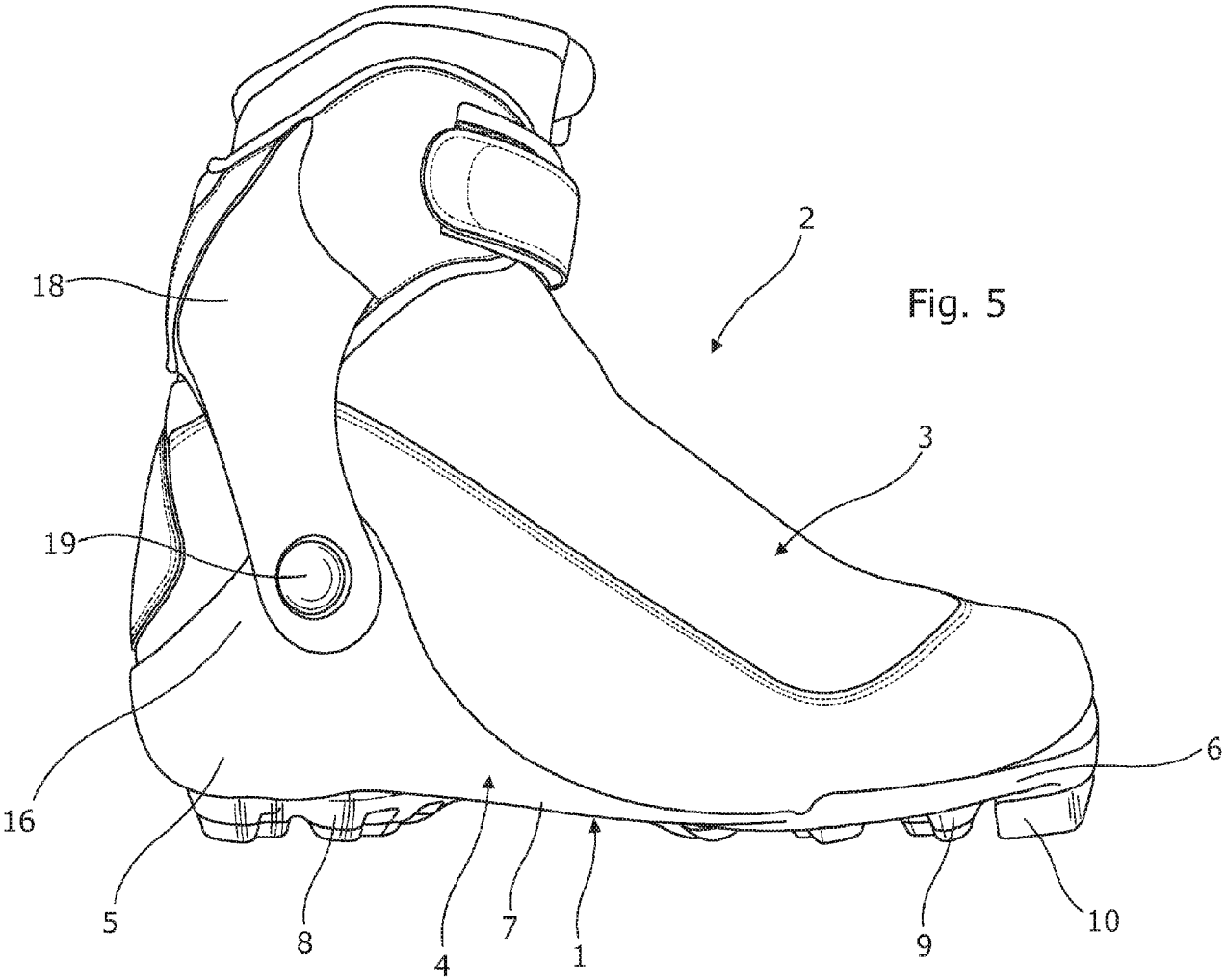
FIG. 5 is a side view of a ski boot in accordance with the second aspect of the present invention that incorporates a base as shown in FIGS. 1 to 3.

FIGS. 1 to 3 of the drawings show a base 1 adapted for use on a Nordic ski boot and an example of such a boot 2 having an upper 3 is shown in FIG. 5.

However, it should be appreciated that the invention is not limited to such ski boots and by appropriate choice of outsole elements, as described below, a ski boot with a universal boot upper 3 or shell can be produced for use in various types of skiing, e.g., downhill, cross-country, ski-jumping, Telemark, etc.

The upper 3 is configured to encase a wearer's foot and is equipped with appropriate conventional fastening arrangements which will not be described here as the present invention is primarily concerned with the base 1 of the boot 2. The base 1 comprises a one-piece sole 4 defining heel and toe portions 5 and 6 respectively and a mid-section 7 that is located between the heel and toe portions 5 and 6 in a position anatomically beneath the location of the metatarsal bones and the plantar arch of a person wearing the ski boot 2. The heel and toe portions 5 and 6 are adapted to be secured to one or more rigid elastomeric outsole elements 8, 9, 10 to form a base 1 that can then be 5 connected to the upper 3 during manufacture of the boot 2. Generally, therefore, the heel and toe portions 5 and 6 of the sole 4 lie adjacent respective heel and toe outsole elements 5 and 6. In the illustrated embodiment, the heel and toe outsole elements 8 and 9 respectively are permanently bonded to the heel and toe portions 5 and 6 of the sole 4 to form a base 1 of unitary construction that can then be secured to the upper 3. However, the outsole element 10 comprises a rigid bar 11 and is fastened, possibly in a releasable manner via releasable fasteners 12, to the sole 4 at a forward end of the toe outsole element 8. The fasteners 12 therefore penetrate through the toe outsole element 9 into the sole 4. Preferably, the fasteners 12 also penetrate through the sole 4 so that they can be unfastened and the outsole element 10 detached and replaced, if necessary. In an alternative arrangement (not shown) the outsole element 10 may be secured directly to the sole 4 adjacent a forward end of the toe outsole element 9, which in this case does not need to extend as far as the front tip of the sole 4.

The outsole elements 8, 9, 10 locate between the sole 4 and a ski binding and least one of them, namely, element 10 in the present example, is adapted for attachment to a Nordic ski binding. In other embodiments (not shown), one or more of the other outsole elements 8, 9 may also be adapted for securement to a ski binding in place of or in addition to the outsole element 10 to fit the base for attachment to different types of ski boot. In addition, the heel and toe outsole elements 8 and 9 provide walking surfaces that contact the ground when the boot 2 is not connected to a ski binding.

The construction of the base 1 will now be described in more detail.

The sole 4 has a fibre-reinforced composite structure wherein a majority of the fibres in the mid-section 7 of the sole 4 are angled at an acute angle with respect to a longitudinal axis L of the sole 4. In the present example, this is achieved by manufacturing the sole 4 in the form of a laminate wherein a plurality of layers 13 of woven fabric comprising warp yarns 14 and weft yarns 15 are encapsulated within a polymer matrix. Preferably the warp yarns 14 and the weft yarns 15 are both carbon-fibre yarns and the polymer matrix is preferably an epoxy-based resin. The sole 4 is therefore moulded in a known manner, for example, using a vacuum bag moulding process wherein a plurality of polymer-coated fabric layers 13 are laid up one on top of the other over a rigid mould to which suction is applied and the polymer is cured using heat and pressure applied via a flexible membrane or bag. The individual fibres of the fabric layers 13, which generally align along the longitudinal axis of the yarn in which they are incorporated, are therefore encapsulated by the polymer matrix so that the resulting moulded sole 4 has strength yet retains flexibility.

Figure 4A:
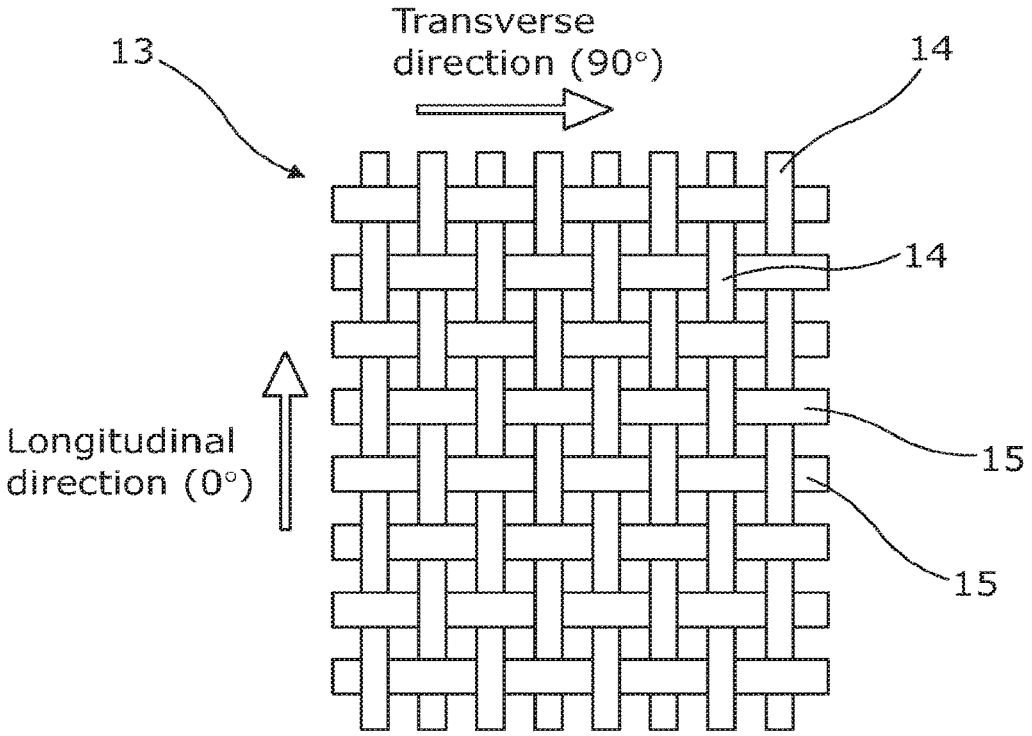
FIGS. 4*a* and 4*b* are schematic representations, to an enlarged scale, of two layers of a laminate used to form the base shown in FIGS. 1 to 3 and illustrating the manner in which the layers are orientated relative to a longitudinal axis of the base.
Figure 4B:
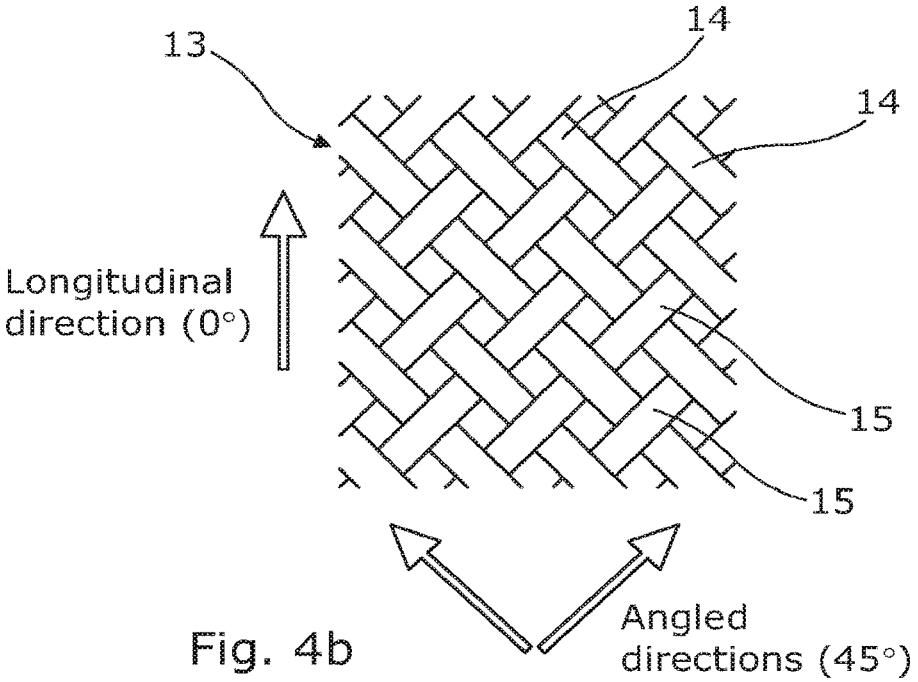

Preferably, some of the fabric layers 13, such as the layer shown in FIG. 4*a*, are arranged so that the fibres forming either the warp yarns 14 (as in FIG. 4*a*) or the weft yarns 15 in the mid-section 7 of the sole 7 are substantially aligned with the longitudinal axis L of the sole. However, the majority of the fabric layers 13, such as the layer shown in FIG. 4*b*, are arranged so that the warp yarns 14 and the weft yarns 15 arc angled at an acute angle with respect to the longitudinal axis L of the sole 4, typically at ±45°±20° to the axis L.

In addition to the laminate structure of the sole 4 described above, the sole 4 is preferably moulded with a heel portion 5 that comprises upstanding portions 16 which wrap up around the back and sides of the heel of the ski boot 3. The upstanding portions 16 at the sides of the sole 4 are provided with moulded-in holes 17 to enable an ankle cuff or part of an ankle cuff 18, as shown in FIG. 3, to be connected to the sole 4, for example, by rivets 19, in a hinged manner. The part of the cuff 18 shown in FIG. 3 may be made of woven carbon fibre material similar to the sole 4, the rest of the cuff 18 being made from other fabric and comprising a fastener as shown in FIG. 5. The upstanding portion at the rear of the sole 4 forms a heel counter that provides a direct transfer of loads from the cuff 18 of the boot 2 into the base 1 of the boot, which is a significant advantage. The three-dimensional shape of the heel portion 5 of the sole 4 also increases the torsional stiffness of the boot 2 and increases its bending or flexural stiffness, which increases the performance of the boot 2 in use as indicated above.

In addition to the foregoing, the heel portion 5 of the sole 4 is moulded to define 30 an interior cavity 20 into which is bonded a resilient pad 21. The pad 21 is dimensioned to provide a predetermined heel lift and made of a suitable material that will cushion the foot during use.

After moulding of the sole 4 as described above, the outsole elements 8 and 9 are bonded thereto to form the base 1 that can then connected to a boot upper 2, which is preferably a flexible fabric upper, in a conventional way. The outsole elements 8 and 9 are preferably made of a resilient material, such as rubber or a similar synthetic material, so as to cushion the foot during skiing. When this material is softer it gives a smoother, softer feeling in the ice conditions. It is also more comfortable during walking before and after skiing, especially on hard surfaces like cement and asphalt. If this material is harder it gives a more stable, direct, rigid contact platform that is an advantage in unstable softer snow conditions.

It is important for the outsole elements 8, 9 and 10 to be orientated correctly with regard to the longitudinal axis L of the sole 4 so that the boot can be properly attached to a ski binding and sit in the correct alignment with regard to the ski. This is often a difficult procedure and slight misalignment of the outsole elements 8 and 9 can seriously affect the ski binding attachment capability of the resulting boot and the ski alignment with respect to the boot.

In order to facilitate the correct alignment of the outsole elements 8, 9 and 10, during manufacture the sole 4 is moulded with three pairs of cavities or holes 22, 23 and 24 in addition to the through-hole 17 for attachment of the cuff 18. However, the holes 17, 22, 23 and 24 could be drilled or punched through the sole 4 after moulding, possibly in predetermined positions marked on the sole 4 during the moulding process by indentations or other markers. The pairs of cavities or holes 22, 23 and 24 arc precisely located in the sole 4 with respect to the longitudinal axis L. The first pair 22 is located respectively towards the front and rear ends of the toe portion 6 of the sole 4 whereas the second pair 23 is located respectively towards the front and rear ends of the heel portion 5 of the sole 4. Both of the pairs of cavities or holes 22, 23 align along the longitudinal axis L of the sole 4 and are used to locate the outsole elements 8 and 9 in the correct positions on the sole 4. To this end, each of the outsole elements 8 and 9 is provided with a pair of projections 25 and 26, respectively, that can be fitted into the respective pair of cavities or holes 22, 23 during attachment of the elements 8 and 9 to the sole 4. This 30 ensures that the outsole elements 8 and 9 are positioned and orientated correctly with regard to the sole 4. The projections 25 and 26 may be unitary with the moulded material forming the rest of the elements 8 and 9 or may comprise injected pins, rivets, fasteners, t-nuts, screws or other secure alignment fastening means than can be located into the cavities or holes 22 and 23. In some embodiments, either or both of the outsole elements 8 and 9 may be detachably connected to a structural portion of the sole 4 by at least one fastener that locates in a hole or cavity 22, 23 defined by the sole 4 in a 5 predetermined position relative to a longitudinal axis L of the sole 4. The fastener may also be removable fastener allowing the outsole element to be attached to or detached from the sole as desired.

It will be appreciated that although the illustrated embodiment shows the projections 25 and 26 moulded into the outsole elements 8 and 9 and the holes or cavities 22 and 23 formed in the sole 4, in some embodiments the projections could be carried by the sole 4 to locate in holes or cavities formed in the outsole elements 8 and 9. Such projections may be moulded into the sole 4 or comprise injected pins, rivets, fasteners, t-nuts, screws or other secure alignment fastening means that arc fastened to the sole 4. It will also be appreciated that the projections of each pair need not both be carried by the sole or by an outsole element. In some cases, a projection and a hole or cavity may be carried by both the sole 4 and the outsole element.

In the case of the pair of holes 24, these are located at the forward end of the sole 4 on either side of the longitudinal axis L and accommodate the fasteners 12 used to secure the outsole element 10 that comprises the rigid bar 11. These holes 24 are therefore preferably through holes so that the fasteners 12 can penetrate through the sole 4 rather than being cavities or blind holes, which is a possibility with the pairs of cavities or holes 22 and 23. In the present embodiment, the outsole element 10 sits beneath the toe outsole element 9; and in order to align the two elements 10 and 9 together, a pair of projections 27 on one, in this case the element 10, that locate in cavities or holes (not shown) in the other may also be provided.

Hence, the outsole elements 8, 9 and 10 and the sole 4 can all be precisely aligned together relative to the centreline of the medial to lateral balance point of a ski. In particular, the outsole elements 8, 9 and 10 and the sole 4 can all be precisely aligned together in a forward and aft manner to form a base 1 that is individually adapted for a particularly sized upper to achieve a particular skier's optimal forward, aft balance point, side-to-side alignment and ideal power transfer zone and pivot point. Hence, a ski boot 2 can be manufactured to a skier's precise requirements.

While illustrative embodiments have been illustrated and described, it will be appreciated that various changes can be made therein without departing from the spirit and scope of the invention.

The invention claimed is:

1. A ski boot comprising:

an upper;

a one-piece composite sole fixed to the upper and having a contoured lower surface, the composite sole comprising a heal portion having an upright portion to cooperatively form a heel counter, a toe portion, and a mid-section located between the heel and toe portions; and;

a heel outsole element bonded to the heel portion of the sole, and a toe outsole element bonded to the toe portion of the sole, wherein the heel outsole element and the toe outsole element are configured to locate between the sole and a ski binding;

wherein the heel portion of the of the composite sole has two spaced-apart slidable engagement features defined in the contoured lower surface of the sole, and the heel outsole element has two spaced-apart slidable engagement features configured to engage the spaced-apart slidable engagement features in the heel portion of the sole to precisely locate and orient the heel outsole element on the heel portion of the sole; and further wherein the toe portion of the composite sole has two spaced-apart slidable engagement features defined in the contoured lower surface of the sole, and the toe outsole element has two spaced-apart slidable engagement features configured to engage the slidable engagement features in the toe portion of the sole to precisely locate and orient the toe outsole element on the toe portion of the sole.

2. The ski boot of claim 1, wherein each of the spaced-apart slidable engagement features comprises posts and cavities, wherein the posts and cavities are sized to slidably engage.

3. The ski boot of claim 2, wherein the heel outsole element spaced-apart slidable engagement features comprise spaced apart posts.

4. The ski boot of claim 2, wherein the two slidable engagement features of the toe and heel outsole elements comprise two posts.

5. The ski boot of claim 2, wherein the two spaced-apart slidable engagement features of the toe and heel outsole elements comprises posts that are integrally formed with the toe and heel outsole elements.

6. The ski boot of claim 2, wherein the two spaced-apart slidable engagement features of the toe and heel portions of the composite sole comprise cavities that are moulded into the composite sole during its production.

7. The ski boot of claim 2, wherein the composite sole is a laminate fibre-reinforced composite structure, comprising a plurality of layers of woven fabric having warp carbon fibre yarns and weft carbon fibre yarns encapsulated within a polymer matrix.

8. The ski boot of claim 2, wherein the toe and heel outsole elements comprise rigid elastomeric elements that are bonded to the sole with an adhesive.

9. The ski boot of claim 2, further comprising an additional outsole element having a rigid bar, wherein the additional outsole element is fastened to the sole adjacent to the toe outsole element with at least two fasteners.

10. The ski boot of claim 8, further comprising an additional outsole element having a rigid bar, wherein the additional outsole element is fastened to the sole at the forward end of the toe outsole element.

11. The ski boot of claim 1, further comprising an ankle cuff pivotally attached to the heel counter.

12. The ski boot of claim 1, wherein the heel portion of the composite sole is moulded to define an interior recess, and further comprising a resilient pad secured to the interior recess.

* * * * *